US006575733B1

(12) United States Patent
Staffer

(10) Patent No.: US 6,575,733 B1
(45) Date of Patent: Jun. 10, 2003

(54) FUEL COMBUSTION METHOD AND REACTOR

(75) Inventor: Franz Josef Staffer, Bozen (IT)

(73) Assignee: Gourmeli International N.V., Curacao (NL)

( * ) Notice: Subject to any disclaimer, the term of this patent is extended or adjusted under 35 U.S.C. 154(b) by 0 days.

(21) Appl. No.: 09/554,172

(22) PCT Filed: Nov. 10, 1998

(86) PCT No.: PCT/EP98/07175

§ 371 (c)(1),
(2), (4) Date: Aug. 17, 2000

(87) PCT Pub. No.: WO99/24756

PCT Pub. Date: May 20, 1999

(30) Foreign Application Priority Data

Nov. 10, 1997 (DE) ..... 197 49 688

(51) Int. Cl.[7] ..... F23C 3/00; F23L 7/00

(52) U.S. Cl. ..... 431/8; 431/181; 431/350; 60/749; 60/723

(58) Field of Search ..... 431/4, 190, 8, 431/10, 12, 350, 351, 352, 353, 181, 182, 116, 5, 202, 171; 60/749, 750, 737, 723; 110/238

(56) References Cited

U.S. PATENT DOCUMENTS

| | | | | | |
|---|---|---|---|---|---|
| 2,539,165 | A | * | 1/1951 | Saha | 431/116 |
| 2,823,519 | A | * | 2/1958 | Spalding | 431/350 |
| 3,320,744 | A | * | 5/1967 | Blakely et al. | 60/749 |
| 3,544,254 | A | * | 12/1970 | Battigelli | 431/350 |
| 3,565,562 | A | | 2/1971 | Drivet | |
| 3,804,579 | A | | 4/1974 | Wilhelm | |
| 3,817,690 | A | * | 6/1974 | Bryce et al. | 60/749 |
| 3,921,391 | A | * | 11/1975 | Hall et al. | 60/749 |
| 4,069,005 | A | | 1/1978 | Palani | |
| 4,077,337 | A | | 3/1978 | Demoiseau | |
| 4,115,862 | A | * | 9/1978 | Stewart | 431/12 |

(List continued on next page.)

FOREIGN PATENT DOCUMENTS

| | | |
|---|---|---|
| DE | 1917666 | 4/1969 |
| DE | 2118073 | 4/1971 |
| DE | 2153817 | 10/1971 |
| DE | 2722431 | 5/1977 |
| DE | 3929759 | 9/1989 |
| DE | 4218024 | 6/1992 |
| FR | 2349368 | 4/1976 |
| GB | 0765197 | 11/1953 |
| GB | 1507321 | 3/1975 |
| WO | 9523942 | 9/1995 |

*Primary Examiner*—Henry Bennett
*Assistant Examiner*—Josiah Cocks
(74) *Attorney, Agent, or Firm*—Dorsey & Whitney LLP

(57) ABSTRACT

The invention relates to a method for combustion of fuels of arbitrary state of aggregation, which are burnt with air, possibly with the addition of water, and a reactor therefore, which is intended to optimize the combustion method. A solid, liquid and/or gaseous fuel, possibly water and/or an oxidizing agent are introduced into a reaction chamber (2) in its axial direction under high pressure, the amount of injected pressurized air corresponding to the amount of air necessary for the complete combustion, and the introduced mixture is led to a deflection surface (7) in the interior of the reaction chamber (2), whereby it is atomized, sublimates and/or evaporates and burns explosively, before it can reach the wall or the bottom of the reaction chamber (2). The reactor (1) for this combustion method features a hyperboloidal reactor head (3), which is disposed adjacent to the outlet opening of the reaction chamber (2) and the cross-section of which widens from there, whereby the reactor (1) is shaped like a nozzle.

12 Claims, 3 Drawing Sheets

Figure 1:
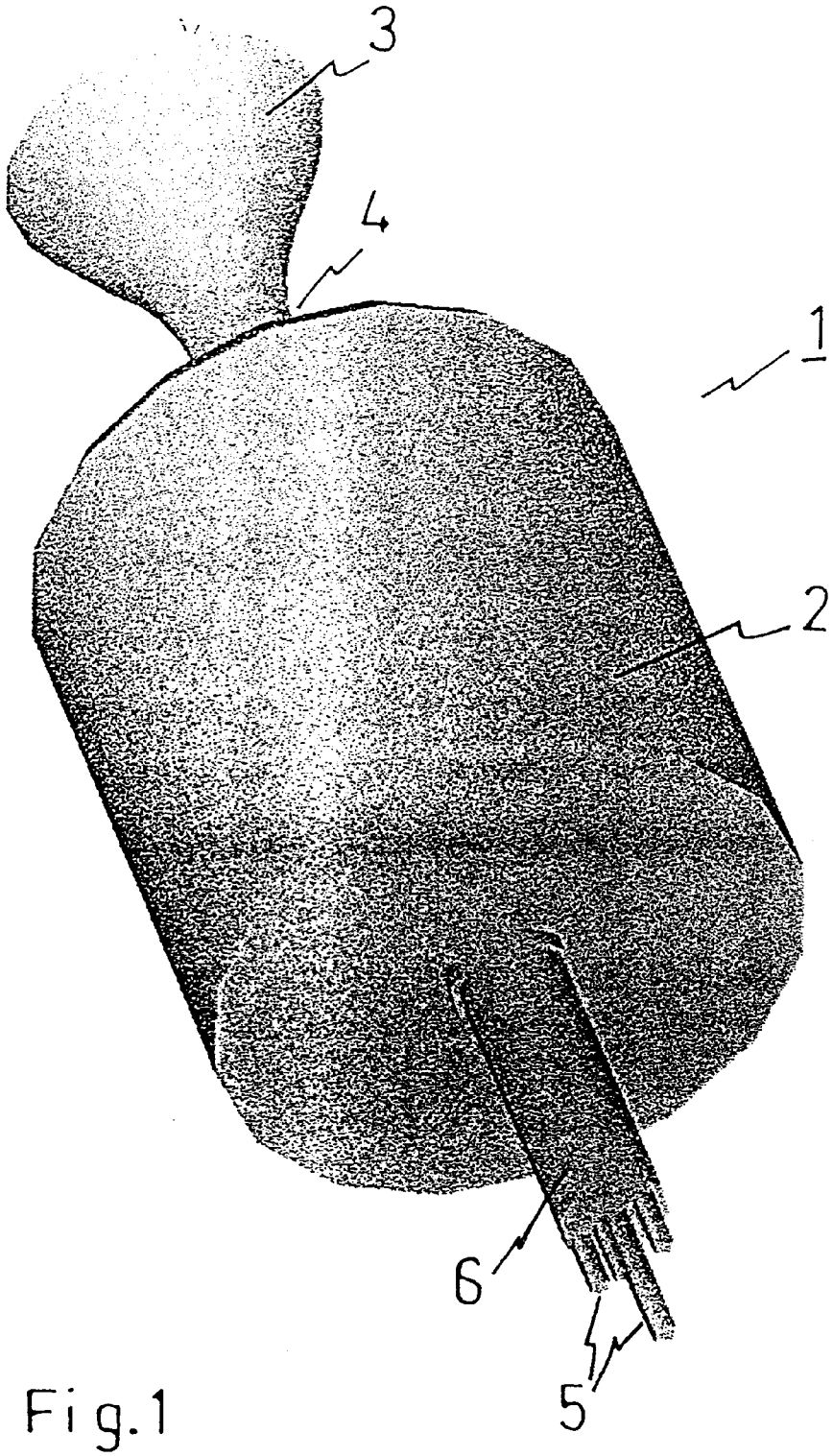

U.S. PATENT DOCUMENTS 4,203,717 A * 5/1980 Facco et al. ..... 431/182
4,726,759 A * 2/1988 Wegener ..... 431/4
4,925,387 A * 5/1990 Locanetto et al. ..... 431/187
4,972,823 A * 11/1990 Stadin ..... 431/352
5,055,030 A * 10/1991 Schirmer ..... 431/10
5,095,696 A * 3/1992 Gulati et al. ..... 60/749
5,236,327 A * 8/1993 Flanagan et al. ..... 431/350
5,328,355 A * 7/1994 Kobayashi et al. ..... 431/350
5,456,216 A * 10/1995 Kaji et al. ..... 431/181
5,630,320 A * 5/1997 Matsuda et al. ..... 60/749

* cited by examiner

FUEL COMBUSTION METHOD AND REACTOR

This applications claims the priority of international patent application number PCT/EP98/07175, filed Nov. 10, 1998, and of German patent application number 197 49 688.1, filed Nov. 10, 1997, both of which are incorporated herein by reference.

The invention is related to a method for the combustion of fuels, in which the fuels are burnt together with air, possibly with the addition of water and/or an oxidizing agent, and a reactor for such a combustion method with a reaction chamber having supply openings for the fuel, the air, possibly the water and/or an oxidizing agent and an outlet opening for the combustion products.

An apparatus and a method for the combustion of oil with the addition of water are known of WO95/23942, in which oil is introduced into a combustion chamber until an oil bath has formed, which is then preheated to a temperature between 250° C. and 350° C. Then water is sprayed onto the surface of the hot oil bath, which results in a flame eruption with the simultaneous supply of air into the combustion chamber. The level of the oil bath should not remain under a height of 3 to 4 mm during combustion in order to prevent an interruption of the combustion. The apparatus used to this purpose includes in general a combustion chamber in the form of a frustrum of a pyramid or a cone with lateral supply openings for oil and water from corresponding reservoirs. The oil bath is electrically heated. Air enters along with the water into the interior of the combustion chamber. The flame with a temperature of 1200° C. to 2000° C. is introduced into an oven via a cylindrical tube for heating purposes.

In this known method of combustion especially of waste oils the temperature gradient appearing in the oil bath in the direction to the bottom has proved to be disadvantageous, because the bottom temperature can be lower than the evaporation temperatures of heavy fractions in the waste oil the result of which is that the latter form a not completely burnable oil mass at the bottom of the combustion chamber. Injecting the oil via a nozzle is not practical, because residues and highly viscous components in the waste oil will lead to a clogging of the nozzles. Moreover the entire apparatus with its feeding and preheating means gets constructively complex. Because of the remaining residues the process control is hard to perform, especially when shutting down. Therefore the facility is not suited for a continuous operation.

From GB 765 197 an apparatus for the combustion of liquid and liquefiable fuels is known, which consists of a cylindrical combustion chamber with an adjacent fire space, which is open to the top. The liquid fuel is radially or tangentially introduced into the interior of the combustion chamber, and air is separately introduced tangentially, while the fuel is contacting the inner surface of the combustion chamber and is evaporated and burnt there. Temperatures appearing in the fire space are between 1500° C. and 1800° C. With incomplete combustion by reduced air supply the fuel is cracked with the aid of supplied vapour, whereby heavy oils are decomposed into lower hydrocarbons, hydrogen and carbon monoxide.

Also in this known combustion method the way of supply is technically demanding, and moreover the danger exists that in certain wall regions the temperature is not sufficient for evaporation of heavier waste oil fractions, which then gather at the bottom of the combustion chamber and form a non-burnable residue there. Water vapour is here not provided for the actual combustion but only for cracking of heavy oils.

In U.S. Pat. No. 4,069,005 the combustion of a water/fuel/air mixture in the presence of a metal catalyst (nickel) is proposed, wherein in the interior of the burner several stacked plates, which may also consist of the metal catalyst, can be disposed, to increase the efficiency of the resulting cracking. In the apparatus serving this purpose liquid fuels and water are respectively dropped upon the catalyst from above, the plates having been heated to a temperature above 800° C. in a preheating phase. The rising vapours are led along the metal catalysts, whereby easily burnable, gaseous hydrocarbons are generated by cracking, which burn in the further process, whereby combustion gases of 800° C. to 1000° C. are generated.

For the generation of a long flame for heating an industrial boiler in U.S. Pat. No. 3,804,579 oil and air are burnt together with water vapour, which is generated in a heat exchange coil by the flame. Here the extended flame burns at about 730° C.

Finally from DE 39 29 759 C2 a facility for burning waste oil products is known, in which the waste oils are mixed with a usual heating oil with a known smaller viscosity, such that an average product with constant viscosity is, formed, which is then preheated and injected into a tank. On the opposite side of the tank input devices for air, water and common neutralizing agents are provided. For injecting the oil mixture air or water vapour is used. The control facility for the mixing ratio of the oils and the injection apparatus for the oil mixture with additional supply leads for air and neutralizing agents lead to a constructively complex facility, which is hard to control, and which cannot work efficiently, because apart from the actual combustion product of waste oil considerable amounts of normal heating oil have, to be burned additionally, which largely limits the disposal capacity. The simple combustion tank cannot support the combustion process.

It is an object of the present invention to provide a method for the environmentally friendly combustion of fuels of an arbitrary state of aggregation, possibly with the addition of water and/or an oxidizing agent, in which the fuel is burnt without residues with a high energy efficiency. The reactor suitable for this is intended to optimize the combustion process in continuous operation with a low constructive effort, and it should be as maintenance-free as possible, and it should be self-cleaning.

According to the invention the solid and/or liquid and/or gaseous fuel, possibly the water and/or an oxidizing agent are introduced into a reaction chamber under high pressure in axial direction by pressurized air, the amount of injected pressurized air corresponding to the amount of air, which is necessary for the complete combustion, the introduced mixture is led to a deflection surface in the interior of the reaction chamber, whereby it is further atomized, liquid components evaporate, solid ones sublimate and the mixture burns explosively, before it can reach the wall of the bottom of the reaction chamber. The explosive combustion process can be explained by the high degree of the surface increase of the mixture introduced into the reaction chamber:

(a) the fuel supplied by pressurized air is disintegrated and atomized, when it is injected into the reaction chamber, (b) the existing pressure is still sufficient to lead the fuel with high velocity to a deflection surface in the interior of the reaction chamber, where an impingement and a reflection with a further distribution and atomization are caused.

Additional water injected with pressurized air is atomized into droplets, when entering the reaction chamber, the droplets changing into water vapour and being distributed into all directions in the interior space of the reaction chamber by the deflection surface. The expansion caused by the sudden evaporation supports a mixing of the fuels with the present pressurized air and the water vapour, which leads to an efficient combustion, especially of hardly burnable fuel components. This way a precipitation of fuel at the inner wall and a concentration of residues at the bottom can be more efficiently abided, so that the reactor cleans itself.

The pressurized air flow can be injected at 2 to 10 bar, preferably at 3 to 5 bar into the reaction chamber. At these pressures the combination of the atomization at the exit from the supply lead with the one caused by the impact onto the deflection surface in the interior space of the reaction chamber is especially efficient.

The fuels, the water and/or the oxidizing agent are respectively introduced separately or as a mixture via one or several Venturi tubes into the pressurized air flow. Gaseous fuel can thereby be individually introduced into the reaction chamber. This way of supply allows for a good dosibility with a low constructive effort and simultaneously enhances the atomizing effect at the entrance into the reaction chamber. The injection into the reaction chamber is accomplished by a normal tube of a small diameter without a nozzle top, whereby a clogging of the nozzle at the time of combustion of waste oils by non-burnable residues or highly viscous components is prevented. The constructive effort is lowered furthermore by the use of uniform Venturi tubes for the supply of the fuels and the water.

It is favorable to keep the temperature inside the reaction chamber homogeneous to the axis of the reaction chamber by heat conducting reactor walls. When by the deflection surface a symmetric distribution of the mixture inside, the reaction chamber is caused, a more uniform combustion can be achieved at a symmetric temperature distribution.

At a predetermined geometry of the reaction chamber the inflow velocities into the reaction chamber of the mixture to be burnt can be adjusted, so that the resulting combustion flame leaves the reaction chamber at least with the velocity of sound and the resulting heat energy is transported to the outside for further use. This can be further improved by suitable reactor geometries as described below.

The ignition of the mixture in the reaction chamber is preferably performed by a starter flame or by a generated spark. It can be advantageous to preheat the fuels, the water or the air by the waste heat generated in the combustion, before they are introduced into the reaction chamber. Especially heavy oil becomes easier transportable by the decrease in velocity achieved hereby. The fluid dynamics of the combustion process can be influenced by inserts, that can be introduced into the inner space of the reaction chamber.

It is advantageous to additionally crack the fuel at the time of combustion, wherein as catalyst e.g. a nickel containing material can be used.

The reactor according to the invention has a hyperboloid reactor heads which is adjacent to the outlet opening of the reaction chamber and the cross section of which increases from there. The combustion flame burns at this reactor head. The nozzle like geometry of the reactor thereby causes an acceleration of the combustion gases with the formation of a corresponding vacuum in the outlet region of the reaction chamber, which leads to a further acceleration of the substances to be burnt in the interior of the reaction chamber in the direction of the outlet opening, which positively influences the combustion and the self-cleaning of the reactor.

The nozzle effect can be improved by a tapering of the reaction chamber at least in its upper part in the direction of the outlet opening, whereby the tapering part can be provided specially as a frustrum of a pyramid or a cone. On the other hand the entire reaction chamber can have a hyperboloid shape, so that it tapers in the direction of the outlet opening.

With the nozzle-shaped reactor geometry it is favorable to embed the supply openings for the fuels (and the water) into the bottom of the reaction chamber, so that these are directed parallel to the axis of the reaction chamber. Hereby the axis of the reaction chamber is determined as the preferred flow direction, in which for the better distribution of the mixture to be burnt, a deflection surface can be disposed, by which the mixture is first deflected from the axis of the reaction chamber and is subsequently directed again to this axis by the mentioned nozzle effect. Moreover, the effusion from the supply openings is favored by the pressure conditions.

A cone, the tip of which is directed against the flow direction of the fuel or a pyramid of a fire resistant material, which is directed in the same way, being disposed in the interior of the reaction chamber along its axis, can be used as deflection surface for achieving a homogeneous distribution. The combustion process can thereby be optimized by symmetric distribution in the cross-section of the reaction chamber of physical quantities such as pressure, flow velocity, turbulence and temperature.

If the fuel is intended to be additionally cracked, it is advantageous to provide a metal catalyst, specially a nickel-containing one, e.g. in the interior walls of the reaction chamber in fire-resistant inserts in the interior of the reaction chamber or even in the deflection surface. A high efficiency of the catalytic cracking can be achieved by a scaled or porous metal catalyst with a large surface.

The reactor can uniformly be fabricated of a material like stainless steel, but it can also, at least partially, be fabricated of a specially heat-resistant and mechanically robust alloy like a Ni—Mo—Cr—Co alloy ("Nimonic"). Moreover, the reactor can be surrounded by an outer insulation of ceramics fibres or fibreglass to reduce the amount of radiated heat and to maintain the temperature in the reaction chamber above 1000° C.

The invention will subsequently be discussed in greater details in an embodiment referring to the figures.

Figure 2:
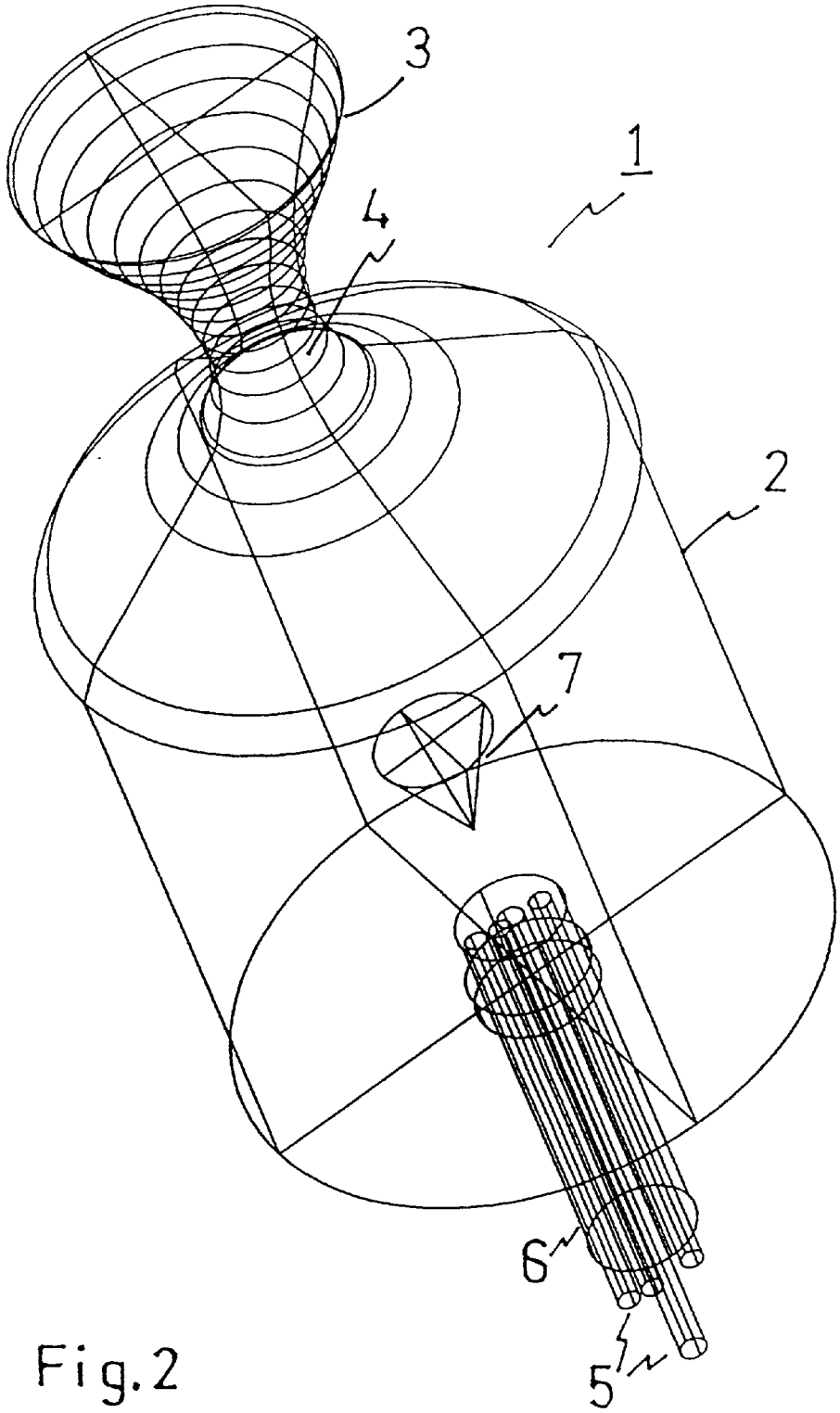
Figure 3:
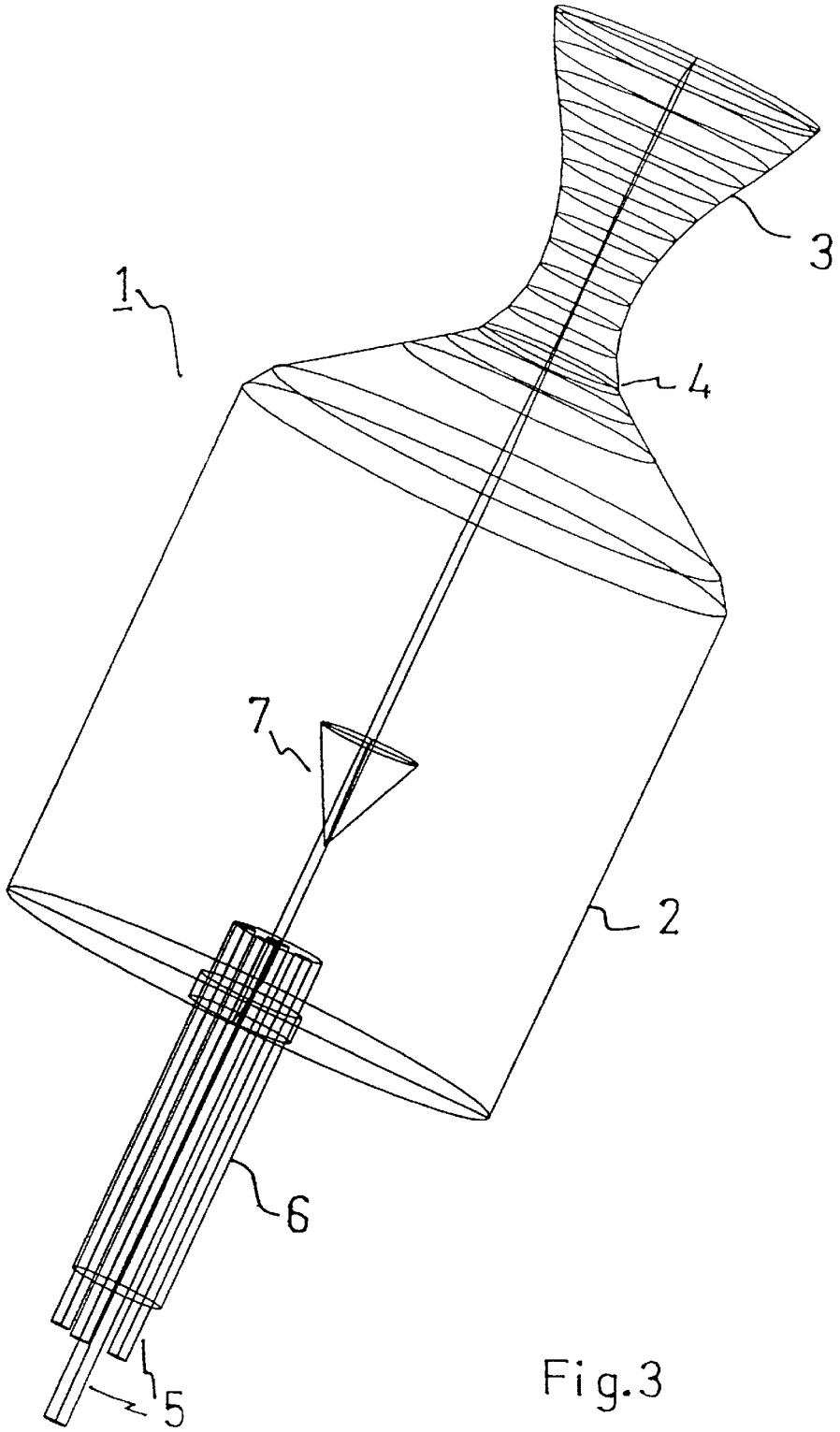

FIG. 1 is a squint side view from below of a reactor according to the invention, FIG. 2 is a squint transparent view from above of the reactor, and FIG. 3 is a transparent side view of the reactor.

The figures show the reactor 1 according to the invention with a reaction chamber 2, with the reactor head 3 adjacent to the outlet opening 4. Supply leads 5 and 6 are embedded in the centre of the bottom of the reactor 1 in coaxial direction. As deflection surface a cone 7, the tip of which is oriented in the direction of the supply leads 5 and 6 is disposed along the axis in the interior of the reaction chamber 2 in this example.

The upper part of the reaction chamber 2 in this example tapers hyperboloidally in the direction of the outlet opening 4 and continues from there hyperboloidally in the reactor head 3. This geometry causes a nozzle effect, by which flowing gases are sucked out of the interior of the reaction chamber 2 by the vacuum in the area of the outlet opening and the reactor head, whereby the supply pressure in the supply leads 5 and 6 can be additionally reduced. At the same time this enables a self-cleaning of the reactor, because non-burnable particles and residues are sucked by the suction effect out of the interior of the reactor. Such residues can be deposited by filtering the combustion gases.

In this embodiment the reactor has a volume of about 15 litres and is fabricated of stainless steel. It is favorable to fabricate it of a more temperature-resistant and mechanically more solid material such as a Nimonic alloy, which has the following composition: C=0.057; Si=0.18; Mn=0.36; S=0.002; Al=0.47; Co=19.3; Cr=19.7; Cu=0.03; Fe=0.55; Mo=5.74; Ti=2.1; Ti+Al=2.59 (in weight percent), ppm amounts of Ag, B, Bi and Pb, balance nickel. The elements contained therein at the same time cause a catalytic cracking of hydrocarbons. The reactor can be fabricated of this material with wall thicknesses of 3 to 4 mm, which measure 5 to 7 mm with stainless steel. An outer insulation of the reactor 1 of a material of ceramics fibres or fibreglass, which decreases the heat radiation and thus increases the temperature in the interior of the reactor is favorable.

By the supply leads 5, which are formed by Venturi tubes with a diameter of 3 to 7 mm liquid fuel, namely waste oil and heavy oils of different compositions and solid fuel, especially dried olive bagasse and sewage sludges, is sucked by pressurized air of respective (not shown) reservoirs and transported into the interior of the reaction chamber 2 with pressures of 3 to 5 bar. At the exit of the supply leads 5 the fuel flow disintegrates, and the fuel impinges onto the deflection surface 7 with high velocity, from which the fuel is symmetrically distributed into the cross-section of the reaction chamber. Water injected through a supply lead 5 is atomized and evaporates when exiting into the reaction chamber 2, and the water vapour is also symmetrically distributed in the reaction chamber 2. By the supply lead 6, in which the supply leads 5 are disposed, additional pressurized air can be fed on demand, in order to provide the amount of air, which is required for the complete combustion.

About 30 to 40 l/h water and 70 to 80 l/h waste oil are introduced into the reaction chamber 2. Solid fuels like dried biomass are supplied at 110 to 130 l/h. If liquid and solid fuels are also to be introduced the supplied amounts have to be decreased correspondingly. The power of the burner is nearly 1 $MW_t$. The toxic emissions are low to negligible.

The control of the combustion process is performed by measuring the temperature, the amount and the chemical composition of the combustion gases. Accordingly the amounts of the supplied water, air and fuel are controlled.

The illustrated structure of the reactor results in a symmetric distribution of the physical quantities of the combustion process rotationally symmetric with respect to axis points of the reaction chamber 2. In a cross section of the reaction chamber 2 the values of the temperature, pressure, and flow velocity of the gases are almost constant. The temperatures increase from the bottom of the reaction chamber 2 in the direction of the outlet opening 4, wherein a flattening of the temperature gradients is caused by the heat conductive reactor walls in continuous operation.

The fluid dynamic of the combustion process can be adjusted at a change of the reactor geometry and the position and geometry of the deflection surface.

The fuels are completely burnt in the reactor. Possibly not burnable residues are transported by the suction effect out of the interior of the reactor and can be collected with a filter. The nozzle effect of the reactor 1 can be adjusted together with the supply velocity, so that the combustion gases leave the reactor head 3 with the velocity of sound at a temperature of about 1200 to 1500° C.

Different industrial applications of the reactor and combustion method of the invention are favorable. For example, with the hot combustion gases a fluid bed can be operated, in which sand is penetrated by hot gas. Such fluid beds are usually used to clean objects (for example, of varnish residues). This use is also favorable for the disposal of special waste. Biomass can be subjected to a pyrolysis process on the fluid bed by intentional lack of air, whereby solid and gaseous fuels, which can directly be supplied to the method of the invention, are obtained. Moreover, the generated combustion gases can be directly used for current generation in a combustion motor. Finally the combustion method of the invention can be used for the combined generation of heat and electric current, i.e. for the operation of vapour turbines and also of gas turbines.

The invention permits an environmentally friendly combustion of hard to dispose waste products like waste oils of different composition, sewage sludges, olive bagasse, mineral carbon and other burnable waste products.

What is claimed is:

1. A method for the combustion of fuel in a reaction chamber having an axis, wherein the reaction chamber is capable of burning liquid, solid and gaseous fuels, the fuel is introduced into the reaction chamber in an axial direction by means of pressurized air and burned, said method comprising the steps of:

(a) providing a fuel;

(b) generating a mixture of the fuel and the pressurized air, wherein the amount of pressurized air corresponds to the amount of air required for complete combustion; and (c) leading the mixture to a tapered deflection surface disposed entirely within an interior of the reaction chamber, whereby the mixture is distributed, so that any liquid components are further atomized and evaporated and any solid components are further atomized and sublimated and the fuel mixture starts to burn explosively, before it can reach the wall or the bottom of the reaction chamber, with a combustion flame occurring at a reactor head coupled with the reaction chamber and having a hyperboloidal shape.

2. The method of claim 1, wherein the pressurized air flow is injected into the reaction chamber at a pressure of about 2 to 10 bar.

3. The method of claim 1, wherein the inflow velocities into the reaction chamber are adjusted so that the combustion flame leaves the reaction chamber at least with the velocity of sound at a predetermined geometry of the reaction chamber.

4. The method of claim 1 wherein the fuel is burned with water present.

5. The method of claim 1, wherein an oxidizing agent is used with the fuel.

6. The method of claim 1, wherein a hydrocarbons containing fluid is catalytically cracked in the combustion.

7. A reactor capable of combusting liquid, solid, and gaseous fuels, wherein fuels are burned together with air, said reactor comprising:

a reaction chamber with supply openings for the fuel and the air;

an outlet opening for the combustion products;

a hyperboloidal reactor head disposed adjacent to the outlet opening of the reaction chamber; and a tapered deflection surface disposed entirely within an interior of the reaction chamber for distributing a fuel.

8. The reactor of claim 7, wherein the reaction chamber tapers at least at the upper part in the direction of the outlet opening.

9. The reactor of claim 8, wherein the tapered part of the reaction chamber is formed as a frustum of a pyramid or a cone.

10. The reactor of claim 8, wherein the reaction chamber is formed hyperboloidially.

11. The reactor of claim 7, wherein the openings of the supply leads are embedded in the bottom of the reaction chamber and are directed parallel to the axis of the reaction chamber.

12. The reactor of claim 7, wherein the deflection surface is formed by a cone or pyramid, the tip of which points in the direction of the supply openings.

* * * * *

UNITED STATES PATENT AND TRADEMARK OFFICE

CERTIFICATE OF CORRECTION

PATENT NO. : 6,575,733 B1
DATED : June 10, 2003
INVENTOR(S) : Franz Josef Staffler It is certified that error appears in the above-identified patent and that said Letters Patent is hereby corrected as shown below:

Title page,
Item [75], Inventor, "Franz Josef Staffler, Bozen (IT)" should be -- Franz Josef Staffler, Bozen (IT) and Vicenzo Branzi, Terzolas TN (IT) -- therefor.

Column 1,
Line 15, please add -- A combustion method and a combustion reactor according to the preamble of claims 1 and 12, respectively are known from the German published application DE 2 118 073. Therein it is proposed for the disposal of contaiminated liquids and sluge to introduce two non-mixable phases of the fuel to be brunt by an atomizing device together with oxygen from the air into a reaction chamber, where a pseudohomogeneous mixture is formed, which is gasified and burnt. Furthermore, in the chamber a recirculation movement is intended to be caused for the homogenizing of the mixture. Herein a part of the fuel is introduced in axial direction into a cylindrical reaction chamber. The reaction chamber can be followed by a relaxation chamber, which serves to cool the waste gases and to deposit unburnt dust particles— therefor.
Line 32,
please add –In a combustion according to DE 2 118 073 it is essential to keep the inner wall of the reaction chamber at a temperature, which corresponds to the one in the gaseous reaction mass. This has disadvantages at the start-up of the burner, because hardly burnable substances can form residues at the bottom of the reaction chamber. The same is true for non-burnable components like dust, which are hardly transported out of the reaction chamber because of the circulation movement in the reaction chamber. Moreover, the geometry of the reactor does not permit high flow velocities—therefor.

Column 2,
Line 33, "oil have, to be" should be -- oil have to be -- therefor.

Column 3,
Line 8, "abided" should be -- avoided -- therefor.
Line 32, "mixture inside, the" should be -- mixture inside the -- therefor.

Column 6,
Line 19, "having an axis" should be -- having a wall, a bottom, supply openings in the bottom and an axis -- therefor.
Line 21, "the fuel is introduced into the reaction chamber" should be -- the fuel being through the supply openings into the reaction chamber -- therefor.
Line 28, "the amount of air required for complete combustion" should be -- the amount of air required for combustion -- therefor.
Line 30, "(c) leading the mixture" should be -- leading the mixture -- therefor.
Line 32, "chamber, whereby" should be -- chamber an on the axis of the reaction chamber, said deflection surface being symmetrical with respect to the axis of the reaction chamber, whereby -- therefor.

UNITED STATES PATENT AND TRADEMARK OFFICE

CERTIFICATE OF CORRECTION

PATENT NO. : 6,575,733 B1
DATED : June 10, 2003
INVENTOR(S) : Franz Josef Staffler It is certified that error appears in the above-identified patent and that said Letters Patent is hereby corrected as shown below:

Column 6 cont'd

Line 32, "mixture is distributed, so that" should be -- the mixture is deflected from the deflection surface and distributed symmetrically in the interior of the reaction chamber, so that -- therefor.

Line 36, "explosively, before" should be -- explosively within the interior of the reaction chambers, before -- therefor.

Line 55, "fuels are burned together with air" should be -- fuels are burned with air -- therefor.

Signed and Sealed this

Fourth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,575,733 B1
APPLICATION NO. : 09/554172
DATED : June 10, 2003
INVENTOR(S) : Franz Josef Staffler It is certified that error appears in the above-identified patent and that said Letters Patent is hereby corrected as shown below:

Title page,
Item [75], Inventor, "Franz Josef Staffler, Bozen (IT)" should be -- Franz Josef Staffler, Bozen (IT) and Vicenzo Branzi, Terzolas TN (IT) -- therefor.

Column 1,
Line 15, please add -- A combustion method and a combustion reactor according to the preamble of claims 1 and 12, respectively are known from the German published application DE 2 118 073. Therein it is proposed for the disposal of contaiminated liquids and sluge to introduce two non-mixable phases of the fuel to be brunt by an atomizing device together with oxygen from the air into a reaction chamber, where a pseudohomogeneous mixture is formed, which is gasified and burnt. Furthermore, in the chamber a recirculation movement is intended to be caused for the homogenizing of the mixture. Herein a part of the fuel is intended to flow along the chamber walls and absorb heat from these. In this method the fuel is introduced in axial direction into a cylindrical reaction chamber. The reaction chamber can be followed by a relaxation chamber, which serves to cool the waste gases and to deposit unburnt dust particles -- therefor.
Line 32, please add -- In a combustion according to DE 2 118073 it is essential to keep the inner wall of the reaction chamber at a temperature, which corresponds to the one in the gaseous reaction mass. This has disadvantages at the start-up of the burner, because hardly burnable substances can form residues at the bottom of the reaction chamber. The same is true for non-burnable components like dust which are hardly transported out of the reaction chamber because of the circulation movement in the reaction chamber. Moreover, the geometry of the reactor does not permit high flow velocitles -- therefor.

Column 2,
Line 33, "oil have, to be" should be -- oil have to be -- therefor.

Column 3,
Line 8, "abided" should be -- avoided -- therefor.
Line 32, "mixture inside, the" should be -- mixture inside the -- therefor.

Column 6,
Line 19, "having an axis" should be -- having a wall, a bottom, supply openings in the bottom and an axis -- therefor.
Line 21, "the fuel is introduced into the reaction chamber" should be -- the fuel being through the supply openings into the reaction chamber -- therefor.
Line 28, "the amount of air required for complete combustion" should be -- the amount of air required for combustion -- therefor.
Line 30, "(c) leading the mixture" should be -- leading the mixture -- therefor.
Line 32, "chamber, whereby" should be -- chamber an on the axis of the reaction chamber, said deflection surface being symmetrical with respect to the axis of the reaction chamber, whereby -- therefor.

UNITED STATES PATENT AND TRADEMARK OFFICE

CERTIFICATE OF CORRECTION

PATENT NO. : 6,575,733 B1
APPLICATION NO. : 09/554172
DATED : June 10, 2003
INVENTOR(S) : Franz Josef Staffler It is certified that error appears in the above-identified patent and that said Letters Patent is hereby corrected as shown below:

Column 6 cont'd

Line 32, "mixture is distributed, so that" should be -- the mixture is deflected from the deflection surface and distributed symmetrically in the interior of the reaction chamber, so that -- therefor.

Line 36, "explosively, before" should be -- explosively within the interior of the reaction chambers, before -- therefor.

Line 55, "wherein fuels are burned together with air," should be -- wherein the fuels are burned with air --

Line 64 "chamber for distributing a fuel" should be -- chamber and on an axis of the reaction chamber, said deflection surface being symmetrical with respect to the axis of the reaction chamber, for deflecting a mixture of fuel and air and said mixture symmetrically in the interior of the reaction chamber -- therefor.

This certificate supersedes Certificate of Correction issued November 4, 2003.

Signed and Sealed this

Nineteenth Day of September, 2006

JON W. DUDAS
*Director of the United States Patent and Trademark Office*